US011518556B2

(12) United States Patent
Paoli et al.

(10) Patent No.: US 11,518,556 B2
(45) Date of Patent: Dec. 6, 2022

(54) WRAPPING MACHINE WITH ROTARY PLATFORM

(71) Applicant: ROBOPAC S.P.A., Acquaviva-Gualdicciolo (SM)

(72) Inventors: Giuseppe Paoli, Cesena (IT); Imerio Pagliarani, Gambettola (IT)

(73) Assignee: ROBOPAC S.P.A., Acquaviva Gualdicciolo (IT)

( * ) Notice: Subject to any disclaimer, the term of this patent is extended or adjusted under 35 U.S.C. 154(b) by 0 days.

(21) Appl. No.: 16/617,645

(22) PCT Filed: May 28, 2018

(86) PCT No.: PCT/IB2018/053769

§ 371 (c)(1),
(2) Date: Nov. 27, 2019

(87) PCT Pub. No.: WO2018/220503

PCT Pub. Date: Dec. 6, 2018

(65) Prior Publication Data

US 2020/0180798 A1 Jun. 11, 2020

(30) Foreign Application Priority Data

May 29, 2017 (IT) ..... 102017000058080

(51) Int. Cl.
*B65B 11/04* (2006.01)
*B65B 65/02* (2006.01)

(52) U.S. Cl.
CPC ..... *B65B 11/045* (2013.01); *B65B 65/02* (2013.01)

(58) Field of Classification Search
USPC ..... 53/211
See application file for complete search history.

(56) References Cited

U.S. PATENT DOCUMENTS 5,212,933 A * 5/1993 Cere' ..... B65B 11/025 53/556
7,114,308 B2 10/2006 Cox
(Continued)

FOREIGN PATENT DOCUMENTS

AU 615778 10/1991
AU 2001291519 4/2002
(Continued)

OTHER PUBLICATIONS

International Search Report dated Jul. 30, 2018 in International (PCT) Application No. PCT/IB2018/053769.
(Continued)

*Primary Examiner* — Chinyere J Rushing-Tucker
(74) *Attorney, Agent, or Firm* — Wenderoth, Lind & Ponack, L.L.P.

(57) ABSTRACT

A wrapping machine with rotary platform for wrapping products with one band includes a base, a rotary platform defining a supporting plane and mounted on the base to rotate about a rotation axis perpendicular to the supporting plane, and supporting rollers interposed between the base and platform and distributed around the rotation axis. The machine also includes a guiding upright parallel to the rotation axis, a supporting slide movable along the guiding upright for receiving and retaining a reel of band, an intermediate disc mounted between and coupled to the base and platform to rotate about the rotation axis, the supporting rollers being mounted on the intermediate disc and in contact with the base and platform, and a transmission system for rotating the platform and intermediate disc about the rotation axis.

12 Claims, 3 Drawing Sheets

(56) References Cited

U.S. PATENT DOCUMENTS

| | | | | |
|---|---|---|---|---|
| 9,981,762 | B2 | 5/2018 | Chalmers | |
| 10,689,138 | B2 | 6/2020 | Laghi | |
| 2003/0126833 | A1 | 7/2003 | Marchetti | |
| 2006/0254214 | A1 | 11/2006 | Cox et al. | |
| 2008/0078588 | A1 | 4/2008 | Draper et al. | |
| 2010/0064906 | A1* | 3/2010 | Rossi | B65B 11/045 100/15 |
| 2013/0300047 | A1* | 11/2013 | Hendren | B65B 11/045 269/57 |
| 2014/0353896 | A1* | 12/2014 | Casadei | B65B 65/02 269/61 |
| 2015/0151861 | A1 | 6/2015 | Chalmers | |
| 2016/0137322 | A1* | 5/2016 | Luo | B65B 11/045 53/203 |
| 2018/0079602 | A1* | 3/2018 | Balletti | B65B 35/36 |
| 2019/0002138 | A1 | 1/2019 | Laghi | |
| 2020/0270004 | A1 | 8/2020 | Laghi | |

FOREIGN PATENT DOCUMENTS

| | | |
|---|---|---|
| CN | 103332316 | 10/2013 |
| CN | 104603010 | 5/2015 |
| EP | 1 325 866 | 7/2003 |
| EP | 3 015 374 | 5/2016 |
| WO | 2017/025870 | 2/2017 |

OTHER PUBLICATIONS

International Search Report and Written Opinion of the International Searching Authority dated Jul. 30, 2018 in International (PCT) Application No. PCT/IB2018/053769.

First Office Action Notice dated Feb. 20, 2021 in corresponding Chinese Application No. 201880035071.1 with English translation.

* cited by examiner

WRAPPING MACHINE WITH ROTARY PLATFORM

The present invention relates to a wrapping machine with rotary platform.

In particular, the present invention relates to a wrapping machine for wrapping products with at least one band or film of wrapping material.

This type of wrapping machine comprises a base, a rotary platform, that defines a supporting plane for at least one product and is mounted on the base so as to rotate about a rotation axis substantially vertical and perpendicular to the supporting plane thereof, and a plurality of supporting rollers interposed between the base and the rotary platform and distributed around the mentioned rotation axis.

The wrapping machine further comprises a guiding upright, protruding upwards from the base and extending in a vertical direction substantially parallel to the rotation axis of the rotary platform, and a supporting slide, which is configured to receive and retain a reel of the wrapping material band and is movable along the guiding upright such that, by combining the displacements of the rotary platform about the rotation axis with the displacements of the supporting slide along the guiding upright, the band or film of wrapping material is spirally wrapped around the products.

The known wrapping machines of the aforementioned type are generally of two types.

According to a first type, each supporting roller is mounted on a fork protruding upwards from the base and is arranged in contact with the rotary platform.

According to the other of the two aforementioned types, each supporting roller is mounted on a fork protruding downwards from the rotary platform and is arranged in contact with the base.

As the supporting rollers are arranged in contact with either the base or the rotary platform, the known wrapping machines of the aforementioned type have some drawbacks mainly due to the fact that, because of the unavoidable imperfect planarity of the floor onto which the wrapping machine is arranged, the loads applied by the products on the rotary platform are distributed in a quite uneven way on the supporting rollers, jeopardizing the correct operation, and imply a relatively high wear and a relatively short lifetime of the supporting rollers thereof.

An object of the present invention is to implement a wrapping machine with rotary platform which is free from the aforementioned drawbacks and which is simple to use and cost effective.

According to the present invention a wrapping machine with rotary platform is implemented according to the appended claims.

The present invention will be now described with reference to the enclosed drawings, showing an exemplary and non-limiting embodiment, wherein.

Figure 1:
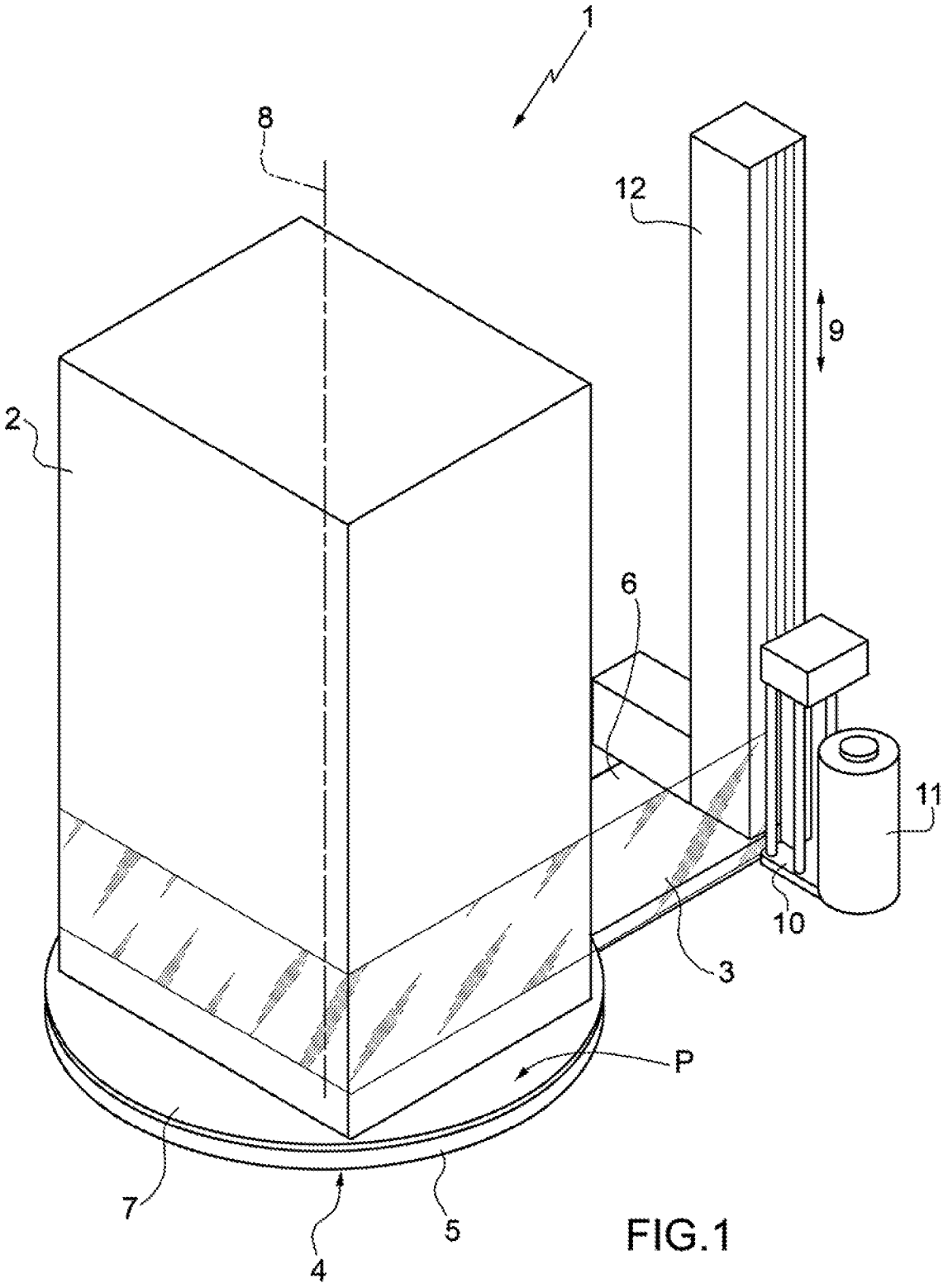
FIG. 1 is a schematic perspective view, with parts removed for the sake of clarity, of a preferred embodiment of the wrapping machine of the present invention.

Referring to FIG. 1, 1 indicates as a whole a wrapping machine for wrapping products 2 with at least one band 3 of wrapping material, in this specific case a band of extendable film.

The wrapping machine 1 comprises a substantially plane base 4 comprising in turn a first plate 5, for instance substantially circular, and a second plate 6, for instance substantially rectangular, connected to each other.

The wrapping machine 1 further includes a rotary platform 7, which is circular-shaped, it is overlapped to the first plate 5 and mounted on the base 4 so as to rotate, with respect to the latter, about a rotation axis 8 substantially parallel to a vertical direction 9.

The platform 7 defines a substantially horizontal supporting plane P for at least one product 2, and cooperates with a supporting slide 10 configured for receiving and retaining a reel 11 of band 3. The supporting slide 10 is movable along a vertical guiding upright 12, substantially parallel to the rotation axis 8, protruding upwards from the plate 6 along the direction 9.

The rotation axis 8 is substantially perpendicular to the supporting plane P. By combining displacements of the platform 7 about the rotation axis 8 with displacements of the supporting slide 10 and consequently, of the reel 11 along the direction 9, the band 3 is spirally wrapped around the product 2.

Figure 3:
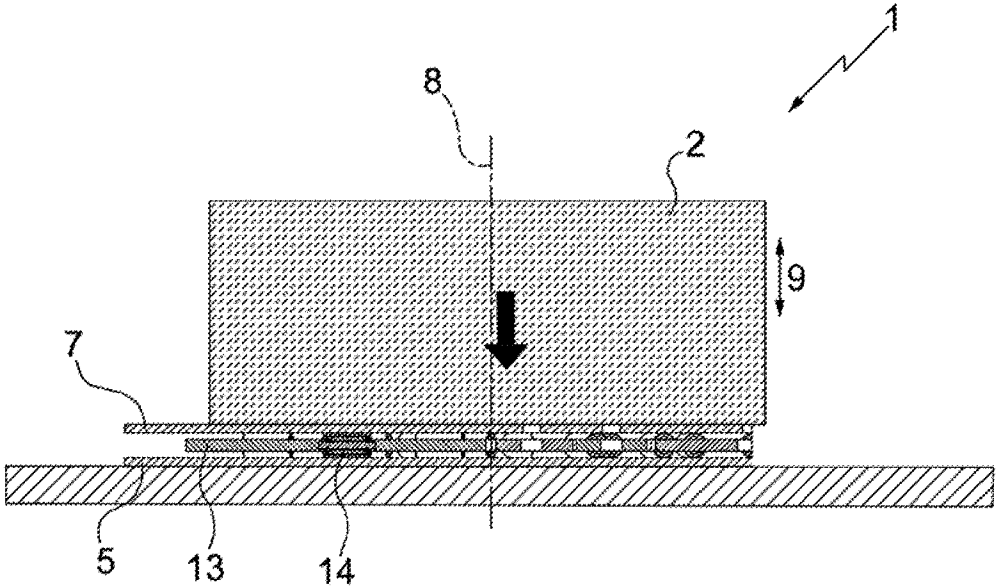
FIG. 3 is a plan schematic view, with parts removed for the sake of clarity, of a detail of the wrapping machine of FIG. 1.
Figure 2:
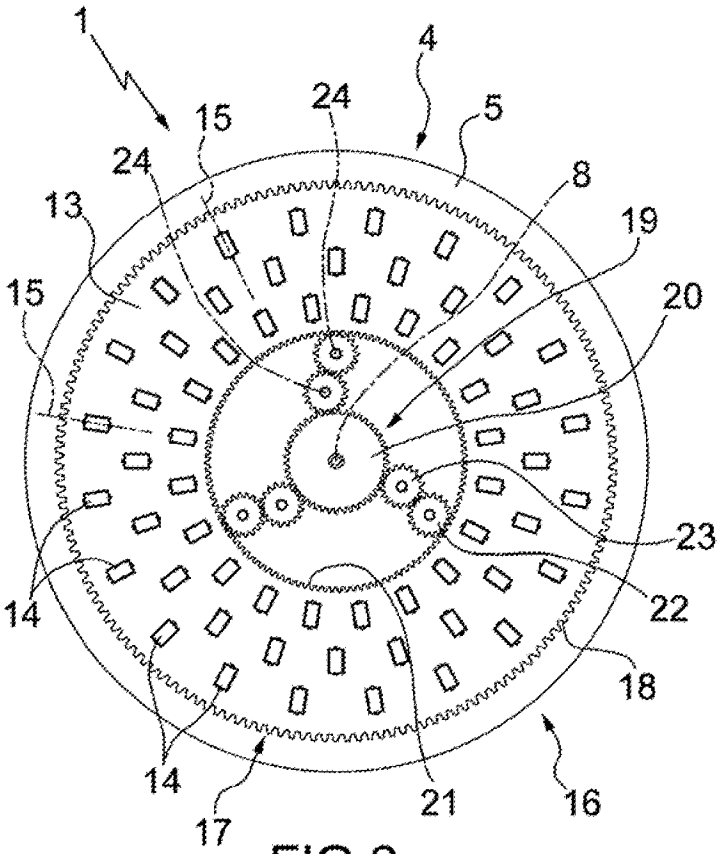
FIG. 2 is a schematic side view, with parts in cross section and parts removed for the sake of clarity, of the wrapping machine of FIG. 1.

According to what shown in FIGS. 2 and 3, the wrapping machine 1 further comprises an intermediate disc 13, which has an annular shape, it is mounted between the first plate 5 of the base 4 and the platform 7 coaxially to the rotation axis 8 and it is rotatably coupled both to the aforementioned plate 5 of the base 4 and to the platform 7 so as to rotate about the rotation axis 8.

The intermediate disc or disc 13 is provided with a plurality of supporting rollers 14, which are mounted on the disc 13, interposed between the base 4 and the platform 7, distributed around the rotation axis 8 and rotatably coupled to the disc 13 so as to rotate, with respect to the latter, about respective rotation axis 15 substantially radial and transversal to the rotation axis 8.

The supporting rollers or rollers 14 show a diameter substantially equal to a distance between the first plate 5 of the base 4 and the platform 7, measured in parallel to the direction 9, so as to be arranged in contact both with the first plate 5 and with the platform 7.

In this specific case, the rollers 14 are distributed according to and along two or more, for instance three, circumferences which are concentric to the rotation axis 8, and the rollers 14 of each circumference are staggered, in particular radially, with respect to the rollers of an adjacent circumference.

The platform 7 is rotated by a transmission system 16, which comprises a driving device 17, and is supported by the rollers 14 which, due to dragging, make the disc 13 rotate about the rotation axis 8.

In alternative embodiments:

the disc 13 is rotated and, due to dragging, determines the rotation of the rollers 14 which, in turn, make the platform 7 supported therefrom rotate;

there are coupling means 19 which makes both the platform 7 and the disc 13 rotate.

The driving device 17 is arranged for rotating the platform 7 or the disc 13 about the rotation axis 8 and comprises for example an electric motor, of the known type and not illustrated, and suitable transmission means.

The coupling means 19 can be provided for kinetically coupling the platform 7 and the disc 13 to each other i.e. for transmitting a rotation between the platform 7 and the disc 13. In other words, the coupling means allows that a rotation given by the driving device 17 to the platform 7 is transmitted to the disc 13 or that a rotation given by the driving device 17 to the disc 13 is transmitted to the platform 7.

In the exemplary and non-limiting embodiment shown in FIGS. 2 and 3, the driving device 17 makes the disc 13 rotate and comprises the electric motor, a gear 18 obtained along the outer perimeter edge of the disc 13 coaxially to the rotation axis 8, and driving means (not shown) including a chain or belt drive or gears adapted to connect to each other an outlet shaft of the electric motor (not shown) to the gear 18 thereof. Alternatively, the disc 13 can be rotated by a belt wrapped about its outer circular edge and rotated by the electric motor through suitable driving means.

In such embodiment, the driving device 17 further includes the coupling device 19, arranged for kinetically coupling the platform 7 and the disc 13 to each other and comprising a gear train that includes, in turn, a central gear 20 fixed to the platform 7 coaxially to the rotation axis 8, a ring gear 21 obtained along an internal perimeter edge of the disc 13 coaxially to the rotation axis 8 and a plurality, in this specific case, three pairs of side gears 22, 23 rotatably mounted onto the first plate 5 of the base 4 so as to rotate, with respect to the latter, about respective rotation axis 24 parallel to the rotation axis 8. Such embodiment of the coupling device 19 allows to rotate the platform 7 with respect to the disc 13 with a gear ratio defined by the features of the train of gears 20, 21, 22, 23.

Each gear 22 is coupled to the ring gear 21, and each gear 23 is coupled to the gear 20 and the relative gear 22.

In use, the rotation motion of the disc 13 about the rotation axis 8 is transmitted to the platform 7 by the gears 22, 23 and the gear 20.

It should be noted that such embodiment of the coupling device 19 allows to rotate the platform 7 with respect to the disc 13 with a gear ratio defined by the features of the train of gears 20, 21, 22, 23.

Alternatively, the coupling device 19 can comprise different means, such as clutch wheels or belts, for transmitting the disc 13 rotation to the platform 7.

In a variant not shown in the figures of the wrapping machine of the invention, the driving device 17 makes the platform 7 rotate and comprises an electric motor, a gear fixed to the platform 7 coaxially to the rotation axis 8, and the driving means includes a chain or belt drive or gears for connecting an outlet shaft of the electric motor and the platform gear to each other.

Alternatively, the gear of the platform 7 can be rotated by a belt wrapped around its outer circular edge and rotated by the electric motor through suitable transmission means.

The coupling device 19, arranged for kinetically coupling platform 7 and the disc 13 therebetween, can include a gear train interconnecting the platform gear 7 and the disc 13 or other different means, such as clutch wheels or belts.

Figure 5:
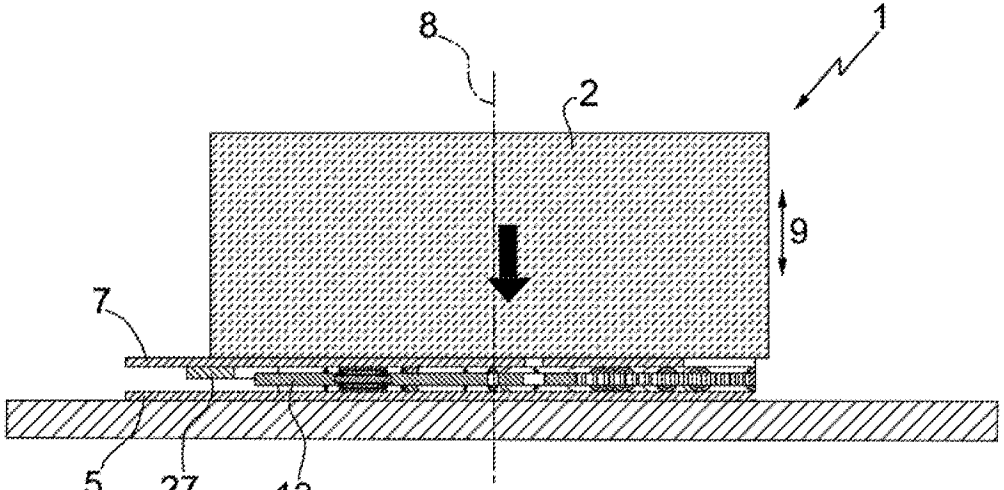
FIG. 5 is a schematic view from below, with parts removed for the sake of clarity, of a detail of the wrapping machine of FIG. 4.
Figure 4:
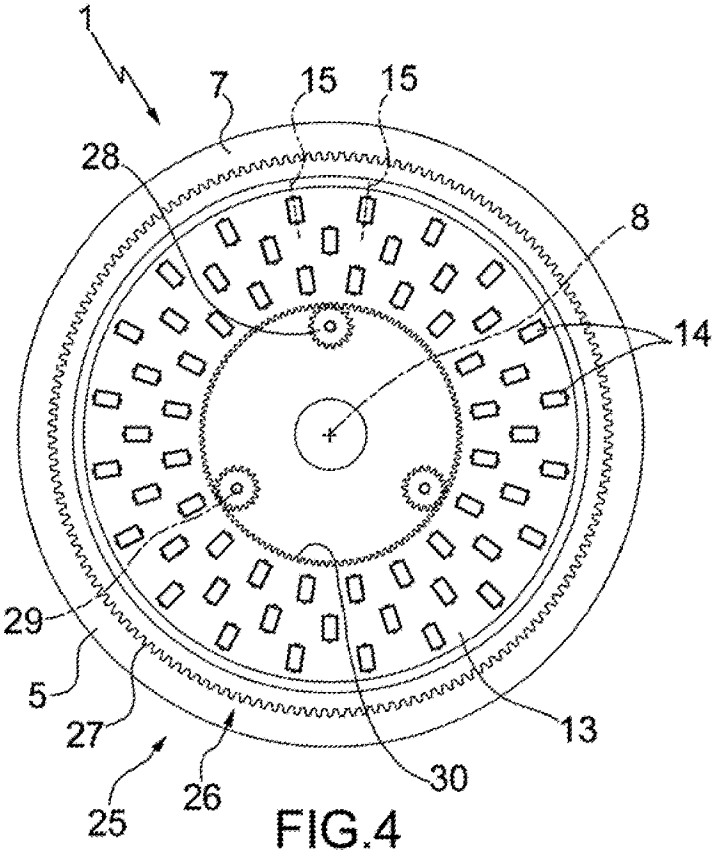
FIG. 4 is a schematic side view, with parts in cross-section and parts removed for the sake of clarity, of a variant of the wrapping machine of FIG. 1.

The variant shown in FIGS. 4 and 5 differs from what shown in the preceding figures solely in that, therein, the transmission system 16 is removed and replaced by a transmission system 25 provided with a driving device 26 for rotating the rotary platform 7 about the rotation axis 8. The driving device 26 includes a known and not illustrated electric motor, a gear 27 fixed to the platform 7 coaxially to the rotation axis 8, and a chain or belt drive or gears (non shown) for connecting the outlet shaft of the electric motor (non illustrated) and the gear 27 thereof to each other.

In this variant of the machine the driving device 26 does not comprise a coupling device as the rotation motion of the platform 7 about the rotation axis 8 is transmitted to the disc 13 by friction through the rollers 14.

The disc 13 is guided in its rotation motion about the rotation axis 8 by a plurality of gears 28 (in this specific case three gears 28), which are rotatably mounted on the first plate 5 so as to rotate about respective rotation axis 29 parallel to the rotation axis 8, and are coupled with a ring gear 30 obtained along an inner perimeter edge of the disc 13 thereof.

According to a not shown variant, the ring gear 30 is removed and gears 28 are removed and replaced by respective guiding bearings mounted in contact with an inner perimeter edge of the disc 13.

As the supporting rollers 14 are mounted on the intermediate disc 13 and are arranged in contact with both the first plate 5 and the platform 7, the wrapping machine 1 has some advantages mainly resulting from the fact that the loads applied by the products 2 onto the platform 7 are distributed in a relatively even way on the supporting rollers 14, ensuring the correct operation of the supporting rollers 14, and ensuring a relatively low wear and a relatively long lifetime of the supporting rollers 14 thereof.

The invention claimed is:

1. A wrapping machine with a rotary platform for wrapping products with at least one band of wrapping material, the wrapping machine comprising:

a base;

a rotary platform, which defines a supporting plane for at least one product and is mounted on the base so as to rotate about a rotation axis perpendicular to the supporting plane;

an intermediate disc having a plurality of supporting rollers mounted thereto that are interposed between the base and the rotary platform and distributed around the rotation axis, the intermediate disc being mounted between the base and the rotary platform and rotatably coupled to the base and to the rotary platform so as to rotate about the rotation axis;

a guiding upright parallel to the rotation axis;

a supporting slide, configured for receiving and retaining a reel of the band of wrapping material, and movable along the guiding upright; and a transmission system, wherein the plurality of supporting rollers are in contact with the base and the rotary platform, and wherein the transmission system is configured to rotate the rotary platform and the intermediate disc about the rotation axis and comprises a driving device arranged for rotating the rotary platform about the rotation axis, wherein the intermediate disc has an annular shape coaxial to the rotation axis, wherein the transmission system further comprises guiding elements for guiding the intermediate disc to rotate about the rotation axis, and wherein the guiding elements comprise (i) a plurality of gears that are rotatably mounted on a first plate of the base so as to rotate about respective rotation axes parallel to the rotation axis and are coupled with a ring gear located along an inner perimeter edge of the intermediate disc, or (ii) a plurality of guiding bearings in contact with the inner perimeter edge of the intermediate disc.

2. The wrapping machine according to claim 1, wherein the driving device comprises a coupling system for kinetically coupling the rotary platform and the intermediate disc to each other.

3. The wrapping machine according to claim 2, wherein the coupling system comprises a gear train that comprises a central gear fixed to the rotary platform coaxially to the rotation axis, the ring gear located along the inner perimeter edge of the intermediate disc coaxially to the rotation axis, and the plurality of gears, which are distributed around the rotation axis, rotatably mounted on the first plate of the base and interposed between the central gear and the ring gear.

4. The wrapping machine according to claim 1, wherein the driving device rotates the rotary platform about the rotation axis, and rotation motion of the rotary platform about the rotation axis is transmitted to the intermediate disc by friction through the supporting rollers.

5. The wrapping machine according to claim 1, wherein the base comprises the first plate and a second plate, connected to each other, and the rotary platform is overlapped to the first plate.

6. The wrapping machine according to claim 5, wherein the first plate is circular.

7. The wrapping machine according to claim 5, wherein the second plate is rectangular.

8. The wrapping machine according to claim 1, wherein each of the supporting rollers has a diameter equal to a distance between the base and the rotary platform.

9. The wrapping machine according to claim 1, wherein the supporting rollers are distributed according to and along at least two circumferences concentric to the rotation axis.

10. The wrapping machine according to claim 9, wherein the supporting rollers arranged along one of the circumferences are staggered with respect to the supporting rollers arranged along another one of the circumferences that is adjacent to the one of the circumferences.

11. The wrapping machine according to claim 1, wherein the plurality of gears are each directly coupled with the ring gear located along the inner perimeter edge of the intermediate disc.

12. The wrapping machine according to claim 1, wherein the ring gear is formed on the inner perimeter edge of the intermediate disc.

* * * * *